US012735799B2

(12) United States Patent
Koizumi et al.

(10) Patent No.: US 12,735,799 B2
(45) Date of Patent: Sep. 15, 2026

(54) PLATING APPARATUS AND PLATING METHOD

(71) Applicant: EBARA CORPORATION, Tokyo (JP)

(72) Inventors: Ryuya Koizumi, Tokyo (JP); Mizuki Nagai, Tokyo (JP); Tensei Sato, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 525 days.

(21) Appl. No.: 17/980,216

(22) Filed: Nov. 3, 2022

(65) Prior Publication Data

US 2023/0203701 A1 Jun. 29, 2023

(30) Foreign Application Priority Data

Dec. 28, 2021 (JP) ..... 2021-214674

(51) Int. Cl.
*C25D 21/12* (2006.01)
*C25D 17/10* (2006.01)

(52) U.S. Cl.
CPC ..... *C25D 21/12* (2013.01); *C25D 17/10* (2013.01)

(58) Field of Classification Search
None
See application file for complete search history.

(56) References Cited

U.S. PATENT DOCUMENTS 4,459,194 A * 7/1984 Fletcher ..... C25D 17/10 204/229.8
2003/0079995 A1* 5/2003 Contolini ..... C25F 7/00 204/227
2005/0067290 A1* 3/2005 Bonkass ..... C25D 21/12 205/84
2005/0183959 A1* 8/2005 Wilson ..... C25D 7/123 205/157
2006/0102467 A1* 5/2006 Herchen ..... C25D 17/008 204/230.2
2015/0275390 A1 10/2015 Tsujino et al.
2015/0276835 A1* 10/2015 Minami ..... C25D 17/001 702/65
2024/0096713 A1* 3/2024 Zhang ..... H01L 21/67253

FOREIGN PATENT DOCUMENTS

JP 2015-161028 A 9/2015
JP 2015-200017 A 11/2015

* cited by examiner

*Primary Examiner* — Louis J Rufo
(74) *Attorney, Agent, or Firm* — BakerHostetler

(57) ABSTRACT

Uniformity in plated film thickness in a plating apparatus is improved. A plating apparatus for plating a substrate by making electric current flow from an anode to the substrate is provided. The plating apparatus comprises: plural anode-side electric wires which are electrically connected to the anode via plural electric contacts on the anode; plural substrate-side electric wires which are electrically connected to the substrate via plural electric contacts on the substrate; plural variable resistors positioned, in at least one of the anode side and the substrate side, in middle positions in the plural anode-side electric wires or the plural substrate-side electric wires; and a controller constructed to adjust each of resistance values of the plural variable resistors.

11 Claims, 7 Drawing Sheets

PLATING APPARATUS AND PLATING METHOD

TECHNICAL FIELD

The present invention relates to a plating apparatus and a plating method.

BACKGROUND ART

In a plating apparatus which performs a plating process by applying an electric current to a substrate soaked in a plating liquid, the electric current is supplied to the substrate via plural electric contacts provided in a periphery of the substrate (for example, refer to Patent Literature 1 (especially, FIG. 9)). Regarding a plating apparatus having a construction such as that explained above, for making film thickness of a plated film formed on a substrate uniform over a surface of the substrate, it is important that respective electric currents, that are substantially equal to one another, be flown through respective ones of the plural electric contacts in a periphery of the substrate. There is a technique, that has been known publicly, for accomplishing the above object, by connecting a variable resistor to each of the plural electric contacts in the periphery of the substrate, and adjusting respective resistance values of the respective variable resistors to thereby make uniform electric currents flow through the plural electric contacts (for example, refer to Patent Literature 1 (especially, paragraph 0059)).

CITATION LIST

Patent Literature

PTL 1: Japanese Patent Application Public Disclosure No. 2015-200017

SUMMARY OF INVENTION

Technical Problem

On the other hand, it is not easy to make a decision regarding setting of a resistance value with respect to each of plural variable resistors. For example, there may be a case wherein contact resistance at respective electric contacts varies, and a case wherein film-thickness distribution within a substrate surface exhibits distribution intrinsic to a plating apparatus.

Solution to Problem

[Mode 1] According to mode 1, a plating apparatus for plating a substrate by making electric current flow from an anode to the substrate is provided; wherein the plating apparatus comprises: plural anode-side electric wires which are electrically connected to the anode via plural electric contacts on the anode; plural substrate-side electric wires which are electrically connected to the substrate via plural electric contacts on the substrate; plural variable resistors positioned, in at least one of the anode side and the substrate side, in middle positions in the plural anode-side electric wires or the plural substrate-side electric wires; and a controller constructed to adjust each of resistance values of the plural variable resistors.

[Mode 2] According to mode 2, the controller, in the plating apparatus of mode 1, is constructed to: determine each of the resistance values of the plural variable resistors by using a machine learning model, wherein input to the machine learning model is plated film thickness at respective points on the substrate, and output from the machine learning model is the respective resistance values of the respective variable resistors; and set the determined resistance values to the plural variable resistors, respectively, and make the plating apparatus perform a plating process.

[Mode 3] According to mode 3, the input of the machine learning model, in the plating apparatus of mode 2, further comprises at least one of a value of electric current supplied between the anode and the substrate, a value of a voltage applied between the anode and the substrate, electric conduction time during that electric current is made to flow between the anode and the substrate, information relating to the shape of the substrate, and information relating to a characteristic of a plating liquid used for plating of the substrate.

[Mode 4] According to mode 4, the information relating to the shape of the substrate, in the plating apparatus of mode 3, comprises at least one of an opening area of the substrate, an opening ratio of the substrate, and thickness of a seed layer formed on a surface of the substrate.

[Mode 5] According to mode 5, the output of the machine learning model, in the plating apparatus of any one of modes 2-4, further comprises a size value of a mask, which is arranged in a position between the anode and the substrate, for adjusting an electric field between the anode and the substrate.

[Mode 6] According to mode 6, the controller, in the plating apparatus of any one of modes 2-4, is constructed to: calculate, by using the machine learning model, the resistance values of the plural variable resistors, respectively, based on at least respective target values of plated film thickness at respective points on the substrate; set the calculated resistance values to the plural variable resistors, respectively; make a plating process be performed in the plating apparatus in which the resistance values have been set to the plural variable resistors, respectively; obtain each of measured values of the plated film thickness at each of the points on the substrate; calculate, by using the machine learning model, the resistance values of the plural variable resistors, respectively, based on at least the respective obtained measured values of the plated film thickness at the respective points on the substrate; and update the machine learning model based on difference between each of the resistance values of the plural variable resistors calculated in the former calculating step and each of the resistance values of the plural variable resistors calculated in the latter calculating step.

[Mode 7] According to mode 7, the controller, in the plating apparatus of any one of modes 1-6, adjusts each of the resistance values of the plural variable resistors in such a manner that a sum of values of resistance on respective paths of the plural anode-side electric wires or the plural substrate-side electric wires becomes substantially equal, regardless of a value of contact resistance at each of the plural electric contacts.

[Mode 8] According to mode 8, the controller, in the plating apparatus of mode 7, adjusts each of the resistance values of the plural variable resistors in such a manner that electric currents, that are substantially equal to one another, flow through the respective paths of the plural anode-side electric wires or the plural substrate-side electric wires.

[Mode 9] According to mode 9, the controller, in the plating apparatus of any one of modes 1-8, adjusts each of the resistance values of the plural variable resistors in such a manner that the resistance value of the variable resistor connected to the electric contact in a position near a center of the anode is determined to be that relatively small, and the resistance value of the variable resistor connected to the electric contact in a position near a periphery of the anode is determined to be that relatively large.

[Mode 10] According to mode 10, each of the resistance values of the plural variable resistors, in the plating apparatus of any one of modes 1-9, is larger than each of the contact resistance values at the electric contacts.

[Mode 11] According to mode 11, each of the resistance values of the plural variable resistors, in the plating apparatus of mode 10, is equal to or larger than a resistance value that is ten times larger than each of the contact resistance values at the electric contacts.

[Mode 12] According to mode 12, a method for plating a substrate by making electric current flow from an anode to the substrate in a plating apparatus is provided; wherein the plating apparatus comprises: plural anode-side electric wires which are electrically connected to the anode via plural electric contacts on the anode; plural substrate-side electric wires which are electrically connected to the substrate via plural electric contacts on the substrate; and plural variable resistors positioned, in at least one of the anode side and the substrate side, in middle positions in the plural anode-side electric wires or the plural substrate-side electric wires: and the method comprises a step for determining each of resistance values of the plural variable resistors by using a machine learning model, wherein input to the machine learning model is plated film thickness at respective points on the substrate, and output from the machine learning model is the respective resistance values of the respective variable resistors, and a step for setting each of the determined resistance values to each of the plural variable resistors, and making a plating process be performed in the plating apparatus.

DESCRIPTION OF EMBODIMENTS

In the following description, embodiments of the present invention will be explained with reference to the figures. In the figures which will be explained below, a reference symbol that is the same as that assigned to one component is assigned to the other component which is the same as or corresponds to the one component, and overlapping explanation of those components will be omitted.

Figure 1:
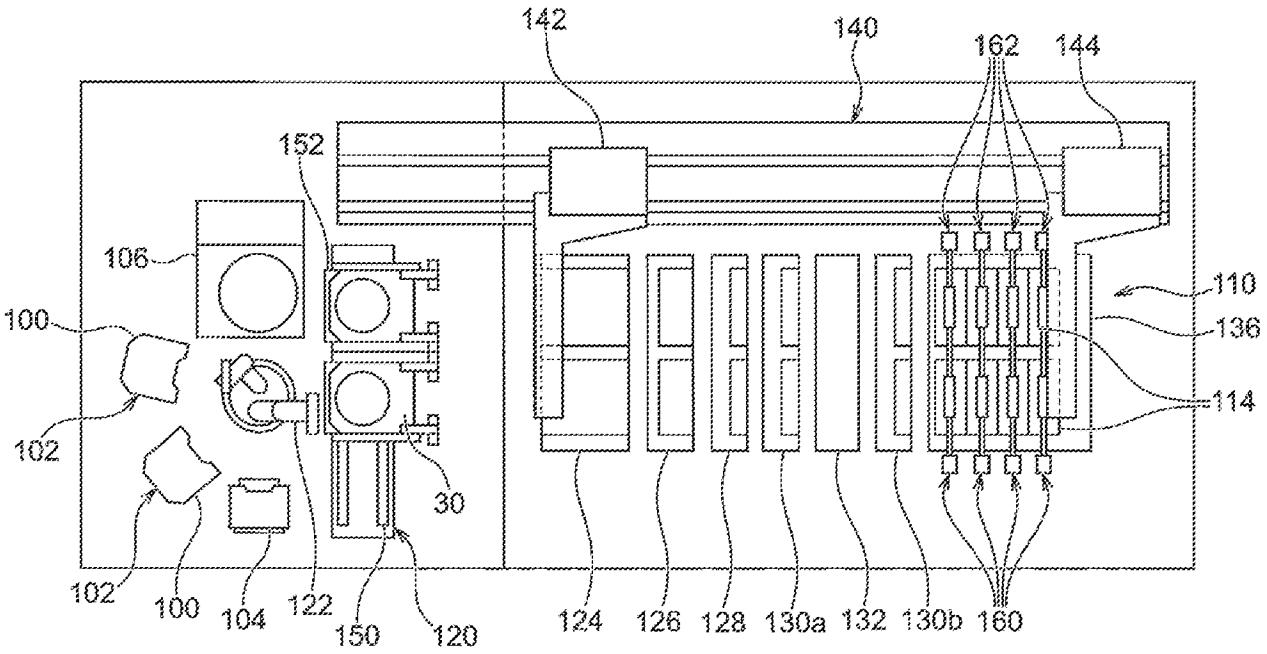
FIG. 1 is a general layout drawing of a plating apparatus according to an embodiment of the present invention.

FIG. 1 is a general layout drawing of a plating apparatus 10 according to an embodiment of the present invention. The plating apparatus 10 comprises: two cassette tables 102; an aligner 104 for aligning, in a predetermined direction, a position of an orientation flat, a notch, or the like of a substrate; and a spin rinse dryer 106 for drying, after completion of a plating process of a substrate, the substrate by rotating it at high speed. A cassette 100, in which a substrate such as a semiconductor wafer or the like is received, is loaded onto the cassette table 102. A load/unload station 120, onto which a substrate holder 30 is loaded and action for attaching/detaching a substrate is performed, is installed in a position close to the spin rinse dryer 106. In a position in the center of the above devices 100, 104, 106, and 120, a transfer robot 122 which carries a substrate between the above devices is arranged.

The load/unload station 120 comprises loading plates 152, each having a flat plate shape and being able to slide in a lateral direction along rails 150. Two substrate holders 30 are loaded, in parallel with each other in a horizontal state, onto the loading plates 152; and, after completion of delivery of a substrate between one of the substrate holders 30 and the transfer robot 122, the loading plates 152 are slid in a lateral direction, and delivery of a substrate between the other of the substrate holders 30 and the transfer robot 122 is performed The plating apparatus 10 further comprises a stocker 124, a pre-wet module 126, a pre-soak module 128, a first rinse module 130*a*, a blow module 132, a second rinse module 130*b*, and a plating module 110. In the stocker 124, storing and temporary storing of a substrate holder 30 is performed. In the pre-wet module 126, a substrate is soaked in pure water. In the pre-soak module 128, an oxide film on a surface of an electrically conducting layer such as a seed layer or the like formed on a surface of a substrate is removed by etching. In the first rinse module 130*a*, a substrate is rinsed together with a substrate holder 30 after pre-soaking, by using a cleaning solution (pure water or the like). In the blow module 132, liquid removal of a substrate is performed after rinsing. In the second rinse module 130*b*, a plated substrate is rinsed together with a substrate holder 30 by using a cleaning solution. The load/unload station 120, the stocker 124, the pre-wet module 126, the pre-soak module 128, the first rinse module 130*a*, the blow module 132, the second rinse module 130*b*, and the plating module 110 are arranged in the order listed above.

For example, the plating module 110 is constructed in such a manner that plural plating tanks 114 are housed in the inside of an overflow tank 136. In the example of FIG. 1, the plating module 110 comprises eight plating tanks 114. Each plating tank 114 is constructed in such a manner that it receives a single substrate in the inside thereof, soaks the substrate in plating liquid held in the inside thereof, and applies plating such as copper plating or the like to a surface of the substrate.

The plating apparatus 10 comprises a transfer device 140 which is arranged in a position on a side of the above respective devices, adopts, for example, a linear motor system, and conveys a substrate holder 30, together with a substrate, between the above respective devices. The transfer device 140 comprises a first transfer device 142 and a second transfer device 144. The first transfer device 142 is constructed to convey a substrate between the load/unload station 120, the stocker 124, the pre-wet module 126, the pre-soak module 128, the first rinse module 130*a*, and the blow module 132. The second transfer device 144 is constructed to convey a substrate between the first rinse module 130*a*, the second rinse module 130*b*, the blow module 132, and the plating module 110. The plating apparatus 10 may be constructed in such a manner that it does not comprise the second transfer device 144, i.e., it comprises the first transfer device 142 only.

In positions on both sides of the overflow tank 136, paddle drivers 160 and paddle followers 162 are arranged, wherein the paddle drivers 160 and the paddle followers 162 drive paddles which are arranged in the plating tanks 114 and work as stirring rods for stirring plating liquid in the plating tanks 114.

An example of a series of plating processes performed by the plating apparatus 10 will be explained. First, a substrate is taken out by the transfer device 140 from the cassette 100 loaded on the cassette table 102, and the substrate is conveyed to the aligner 104. The aligner 104 aligns, in a predetermined direction, a position of an orientation flat, a notch, or the like. The substrate, that has been aligned with respect to the direction by the aligner 104, is conveyed by the transfer robot 122 to the load/unload station 120.

Regarding the load/unload station 120, two substrate holders 30, which have been stored in the stocker 124, are gripped at the same time by the first transfer device 142 in the transfer device 140, and conveyed to the load/unload station 120. Thereafter, the two substrate holders 30 are put, at the same time and horizontally, on the loading plates 152 in the load/unload station 120. In the above state, the transfer robot 122 conveys the substrates to the substrate holders 30, respectively, and the conveyed substrates are held in the substrate holders 30, respectively.

Next, the two substrate holders 30, which hold the substrates, are gripped at the same time by the first transfer device 142 in the transfer device 140, and housed in the pre-wet module 126. Next, the substrate holders 30, which hold the substrates processed in the pre-wet module 126, are conveyed to the pre-soak module 128 by the first transfer device 142, and, in the pre-soak module 128, an etching process is applied to an oxide film on each of the substrates. Following thereto, the substrate holders 30, which hold the above substrates, are conveyed to the first rinse module 130*a*, and the surfaces of the substrates are rinsed by pure water stored in the first rinse module 130*a*.

The substrate holders 30, which hold the substrates with respect to which the rinsing process applied thereto has been completed, are conveyed from the first rinse module 130*a* to the plating module 110 by the second transfer device 144, and housed in the plating tank 114 which has been filled with plating liquid. The second transfer device 144 repeats the above procedures sequentially to thereby sequentially house the substrate holders 30, which hold substrates, in plating tanks 114 in the plating module 110, respectively.

In each of the plating tanks 114, a surface of the substrate is plated by applying a plating voltage between the substrate and an anode (not shown in the figure) in the plating tank 114, and, at the same time, moving the paddle forward and backward, in parallel with the surface of the substrate, by the paddle driver 160 and the paddle follower 162.

After completion of plating, two substrate holders 30, which hold the plated substrates, are gripped at the same time by the second transfer device 144, and conveyed to the second rinse module 130*b*, and the surfaces of the substrates are rinsed by pure water by soaking them in the pure water stored in the second rinse module 130*b*. Next, the substrate holders 30 are conveyed to the blow module 132 by the second transfer device 144, and water droplets remaining on the substrate holders 30 are removed by air-blowing or the like. Thereafter, the substrate holders 30 are conveyed to the load/unload station 120 by the first transfer device 142.

In the load/unload station 120, the processed substrate is taken out from the substrate holder 30 by the transfer robot 122, and conveyed to the spin rinse dryer 106. The spin rinse dryer 106 rotates, at high speed, the plated substrate to thereby dry it. The dried substrate is returned to the cassette 100 by the transfer robot 122.

Figure 2:
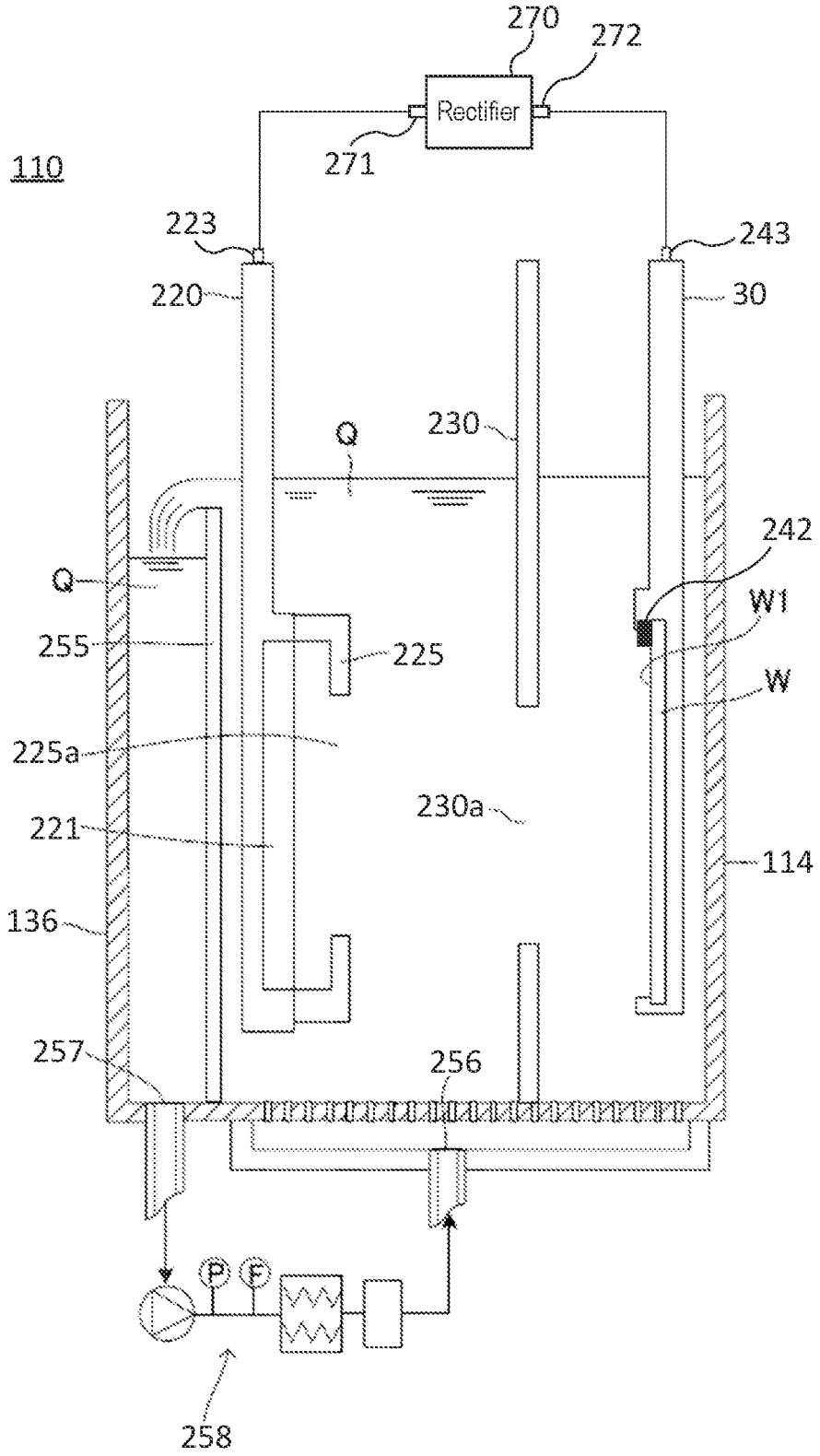
FIG. 2 is a schematic sectional side view of a plating module which is a component of the plating apparatus.

FIG. 2 is a schematic sectional side view of the above-explained plating module 110. As shown in the figure, the plating module 110 comprises an anode holder 220 which is constructed to hold an anode 221, the substrate holder 30 which is constructed to hold a substrate W, the plating tank 114 which stores plating liquid Q including an additive, and an overflow tank 136 which receives and discharges a quantity of plating liquid Q overflowed from the plating tank 114. The plating tank 114 and the overflow tank 136 are separated from each other by a partition wall 255. The anode holder 220 and the substrate holder 30 are housed in the inside of the plating tank 114. As explained above, the substrate holder 30 holding the substrate W is conveyed by the second transfer device 144 (refer to FIG. 1) and housed in the plating tank 114.

In this regard, although a single plating tank 114 only is drawn in FIG. 2, the plating module 110 may be that comprising plural plating tanks 114 as explained above, wherein each plating tank comprises the construction shown in FIG. 2.

The anode 221 is electrically connected to a positive terminal 271 of a rectifier 270, via an electric contact, which is not shown in the figure, on the anode 221 and an electric terminal 223 installed on the anode holder 220. The substrate W is electrically connected to a negative terminal 272 of the rectifier 270, via an electric contact 242 on the substrate W and an electric terminal 243 installed on the substrate holder 30. The rectifier 270 is constructed in such a manner that it supplies a plating electric current between the anode 221 connected to the positive terminal 271 and the substrate W connected to the negative terminal 272, and also measures a voltage applied between the positive terminal 271 and the negative terminal 272.

The anode holder 220 holding the anode 221 and the substrate holder 30 holding the substrate W are soaked in the plating liquid Q in the plating tank 114, and arranged to face with each other in such a manner that the anode 220 and the to-be-plated surface W1 of the substrate W are positioned in parallel with each other. In the state that the anode 221 and the substrate W are being soaked in the plating liquid Q in the plating tank 114, the plating electric current is supplied from the rectifier 270 to them. As a result, metal ions in the plating liquid Q are deoxidized on the to-be-plated surface W1 of the substrate W, and a film is formed on the to-be-plated surface W1.

The anode holder 220 comprises an anode mask 225 for adjusting an electric field between the anode 221 and the substrate W. The anode mask 225 is a member which is virtually tabular and comprises dielectric material, for example, and installed on a front-side surface of the anode holder 220 (a surface on a side facing the substrate holder 30). That is, the anode mask 225 is positioned between the anode 221 and the substrate holder 30. The anode mask 225 comprises a first opening 225*a*, through which the electric current flowing between the anode 221 and the substrate W passes. It is preferable that the diameter of the opening 225*a* be smaller than the diameter of the anode 221. The anode mask 225 may be constructed in such a manner that the diameter of the opening 225*a* is adjustable.

The plating module 110 further comprises a regulation plate 230 for adjusting the electric field between the anode 221 and the substrate W. The regulation plate 230 is a member which is virtually tabular and comprises dielectric material, for example, and arranged in a position between the anode mask 225 and the substrate holder 30 (the substrate W). The regulation plate 230 comprises a second opening 230*a*, through which the electric current flowing between the anode 221 and the substrate W passes. It is preferable that the diameter of the opening 230*a* be smaller than the diameter of the substrate W. The regulation plate 230 may be constructed in such a manner that the diameter of the opening 230*a* is adjustable. Further, a paddle (not shown in the figure), which functions as a stirring rod for stirring the plating liquid Q in the plating tanks 114, is arranged in a position between the regulation plate 230 and substrate holder 30 (the substrate W).

The plating tank 114 comprises a plating liquid supply port 256 for supplying the plating liquid Q to the inside of the tank. The overflow tank 136 comprises a plating liquid exhaust port 257 for discharging a quantity of plating liquid Q overflowed from the plating tank 114. The plating liquid supply port 256 is arranged in a position on the bottom of the plating tank 114, and the plating liquid exhaust port 257 is arranged in a position on the bottom of the overflow tank 136.

When the plating liquid Q is being supplied from the plating liquid supply port 256 to the plating tank 114, a quantity of plating liquid Q overflows from the plating tank 114, and flows into the overflow tank 136 over the partition wall 255. The plating liquid Q flown into the overflow tank 136 is discharged from the plating liquid exhaust port 257, and impurities therein are removed by a filter or the like included in a plating liquid circulating device 258. The plating liquid Q, from which the impurities have been removed, is supplied to the plating tank 114 by the plating liquid circulating device 258 via the plating liquid supply port 256.

Figure 3:
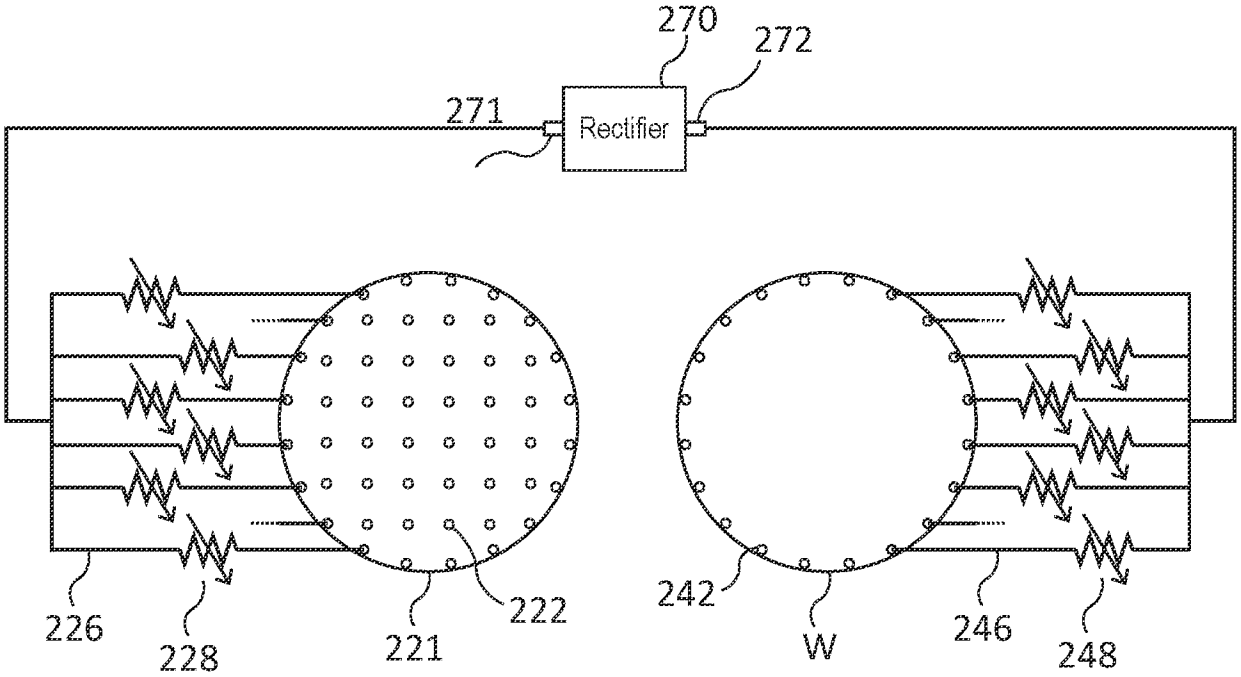
FIG. 3 is a circuit diagram which shows, in more detail, how an anode and a substrate are electrically connected to a rectifier.

FIG. 3 is a circuit diagram which shows, in more detail, how the anode 221 and the substrate W are electrically connected to the rectifier 270 in the plating module 110. The anode 221 comprises plural electric contacts 222 in its back surface (the surface opposite to the other surface facing the substrate W). The plural electric contacts 222 may be arranged over an area from the center to the periphery of the back surface of the anode 221. In a different construction, the plural electric contacts 222 may be arranged only in a part (for example, the periphery) of the back surface of the anode 221. In addition to the back surface of the anode 221, or in place of the back surface of the anode 221, the electric contacts 222 may be arranged in the periphery of the front surface (the surface facing the substrate W) of the anode 221. Similarly, the substrate W comprises, on the back surface (the surface opposite to the other surface facing the anode 221) thereof, plural electric contacts 242. The plural electric contacts 242 may be arranged over an area from the center to the periphery of the back surface of the substrate W. There is a case that the back surface, except for the periphery thereof, of the substrate W is coated by insulating material such as an oxide film or the like. In such a case, the plural electric contacts 242 may be arranged in the periphery of the back surface of the substrate W, or, if possible, the plural electric contacts 242 may be arranged in the periphery of the front surface (the surface facing the anode 221) of the substrate W.

Each of the plural electric contacts 222 of the anode 221 is connected to the positive terminal 271 of the rectifier 270 by electric wiring (hereinafter, an anode-side electric wire) 226. Similarly, each of the plural electric contacts 242 of the substrate W is connected to the negative terminal 272 of the rectifier 270 by electric wiring (hereinafter, a substrate-side electric wire) 246. In this manner, the anode 221 and the substrate W are electrically connected, via the plural electric contacts 222 and the plural anode-side electric wires 226 and via the plural electric contacts 242 and the plural substrate-side electric wires 246, to the rectifier 270, respectively. Thus, electric current supplied from the rectifier 270 flows through the anode 221 and the substrate W via the plural electric contacts 222 and 242. In this regard, it may be possible to adopt a construction wherein plural rectifiers 270 are provided, and plating electric current is supplied from each of the plural rectifiers 270 to each of the plural electric contacts 222 and 242, or to each of groups of some electric contacts which are those included in the plural electric contacts 222 and 242 and positioned close to one another.

A variable resistor 228 is inserted in a middle position in each of the anode-side electric wires 226 which connects each of the electric contacts 222 of the anode 221 and the positive terminal 271 of the rectifier 270 with each other. Each of the variable resistors 228 makes it possible to adjust, in a separate manner, the value of electric resistance between the rectifier 270 and each of the electric contacts 222 on the anode 221. Similarly, a variable resistor 248 is inserted in a middle position in each of the substrate-side electric wires 246 which connects each of the electric contacts 242 of the substrate W and the negative terminal 272 of the rectifier 270 with each other. Each of the variable resistors 248 makes it possible to adjust, in a separate manner, the value of electric resistance between the rectifier 270 and each of the electric contacts 242 on the substrate W. It should be reminded that, for simplification of FIG. 3, some of the plural anode-side electric wires 226 and the variable resistors 228 and some of the plural substrate-side electric wires 246 and the variable resistors 248 only are shown in the figure, and others are omitted from the figure.

In this regard, there may be a case wherein the respective quantities of contact resistance at the respective electric contacts 242 on the substrate W (contact resistance between the surface of the substrate and each electrode positioned on the tip of each substrate-side electric wire 246) are different from one another. Similarly, regarding the contact resistance at each of the electric contacts 222 on the anode 221, there may be a case that respective quantities of the contact resistance thereof are not equal between those of the respective contacts. In the above cases, regarding the electric current flowing through the respective substrate-side electric wires 246, respective electric currents in respective electric current paths become uneven between them, and, as a result, electric current distribution in the surface of the substrate W becomes uneven; consequently, there is a risk that uniformity in film thickness of the plated film formed on the substrate W is deteriorated. Further, in addition to the above matters, regarding the electric current flowing through respective anode-side electric wire 226, if respective electric currents in respective electric current paths become uneven between them, distribution of the electric field between the anode 221 and the substrate W in the plating liquid Q becomes uneven; and the above matter also affects the potential in the to-be-plated surface of the substrate W, and consequently affects uniformity in thickness of the plated film.

The film-thickness distribution of the plated film formed on the substrate W can be controlled by respectively setting the resistance values of the variable resistors 228 and 248. For example, by setting resistance values of the variable resistors 248 to compensate differences between the quantities of contact resistance at the respective electric contacts 242 on the substrate W, respective values of electric resistance between the rectifier 270 and the respective electric contacts 242 can be equalized with one another, in all electric current paths on the side of the substrate W. Further, by setting resistance values of the variable resistors 228 to compensate differences between the quantities of contact resistance at the respective electric contacts 222 on the anode 221, respective values of electric resistance between the rectifier 270 and the respective electric contacts 222 can be equalized with one another, in all electric current paths on the side of the anode 221. As a result, regarding the respective electric currents flowing through the respective substrate-side electric wires 246 and/or the respective electric currents flowing through the respective anode-side electric wires 226, the electric currents in the electric current paths are made uniform between them, and, consequently, uniformity in film thickness of the plated film formed on the substrate W can be improved.

Setting of the resistance values of the variable resistors 228 and 248 is not limited to that for making the electric currents flowing through the substrate-side electric wires 246 and/or the anode-side electric wires 226 uniform. For example, in the construction wherein the electric contacts 242 are arranged in the periphery of the substrate W only, electric current does not flow well in an area close to the center of the substrate W, due to the resistance value of the substrate W itself, specifically, the values of resistance between the center and the periphery of the substrate W, or due to the resistance value of the seed layer on the substrate W. Thus, in such a construction, there is a tendency that the thickness of the plated film on the center area is thinner than that on the periphery area. In view of the above matter, by setting the resistance values of the variable resistors 228 on the side of the anode 221 in such a manner that the resistance values of the variable resistors 228 become smaller as the distances from the variable resistors 228 to the center of the anode 221 become shorter, decreasing of the quantity of electric current flowing toward the center of the substrate W is suppressed, and distribution of the electric current in the surface of the substrate can be made uniform; and, consequently, uniformity in film thickness of the plated film formed on the substrate W can be improved.

In this regard, it is preferable that the resistance values of the variable resistors 228 and 248 be larger than the values of contact resistance at the electric contacts 222 and 242. For example, the resistance value of each of the variable resistors 228 and 248 may be a resistance value that is approximately ten times the value of contact resistance at one of the electric contacts 222 and 242 (for example, an average value of all contact resistance values), or greater than it. By the above construction, effect of variation in the contact resistance of the electric contacts 222 and 242 becomes relatively small, so that it becomes easier to control balance between respective values of electric currents flowing to the respective electric contacts 222 and 242. In this regard, it is necessary that the resistance value of the variable resistors 228 and 248 be set to that smaller than a predetermined upper limit value for preventing the output voltage of the rectifier 270, that is determined in relation to the set output electric current of the rectifier 270, from exceeding a rated value.

Further, since the plural variable resistors 228 and 248 are arranged in parallel and connected to the rectifier 270, the resistance value of each of the variable resistors 228 and 248 becomes larger as the number of the variable resistors 228 and 248 becomes larger, if there is a condition that the plating electric current is constant (that is, a case wherein it is supposed that the value of combined resistance between the rectifier 270 and the anode 221 and between the rectifier 270 and the substrate W is constant). Accordingly, effect of variation in the contact resistance of the electric contacts 222 and 242 on the magnitude of the resistance values of the variable resistors 228 and 248 becomes smaller as the number of the variable resistors 228 and 248 becomes larger; and, as a result, it becomes much easier to control balance between respective values of electric currents flowing to the respective electric contacts 222 and 242.

Figure 4:
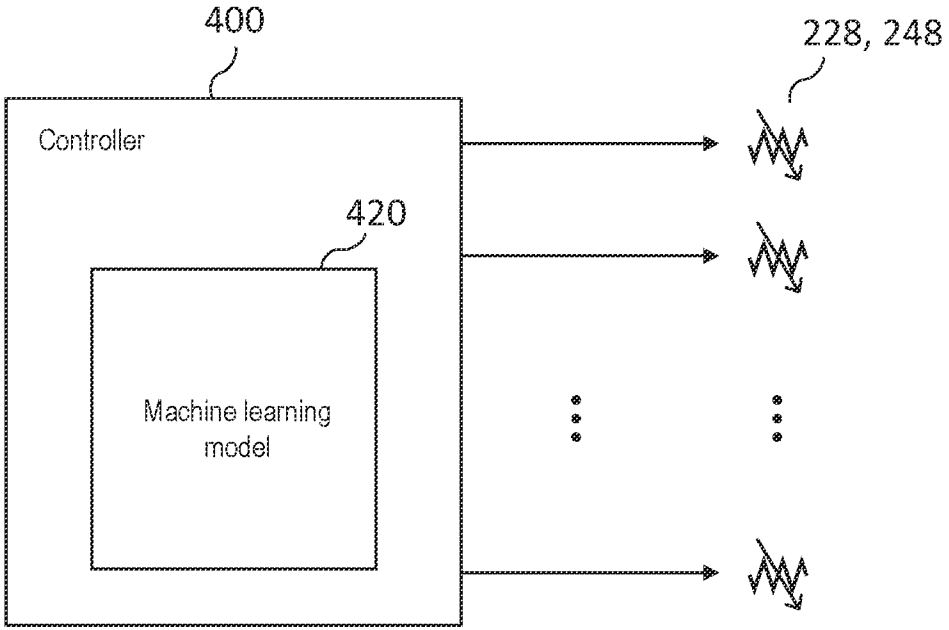
FIG. 4 is a figure showing a controller for controlling resistance values of plural variable resistors.

FIG. 4 is a figure showing a controller for controlling resistance values of plural variable resistors 228 and 248. A controller 400 may be a computer comprising a processor and a memory which are not shown in the figure. In an embodiment, the controller 400 is constructed to control resistance values of the plural variable resistors 228 and 248 by using a machine learning model 420. For example, the machine learning model 420 may be implemented in the controller 400 by reading and executing, by the processor, a program (computer executable instructions) stored in the memory of the controller (computer) 400. The machine learning model 420 is constructed in such a manner that it is trained by using a large quantity of learning data, and it determines respective resistance values of the respective variable resistors 228 and 248 that are required for realizing optimum or desired film-thickness distribution of a plated film formed on a substrate W. The controller 400 is constructed to set resistance values, that are determined by the machine learning model 420, to the variable resistors 228 and 248, respectively.

Figure 5:
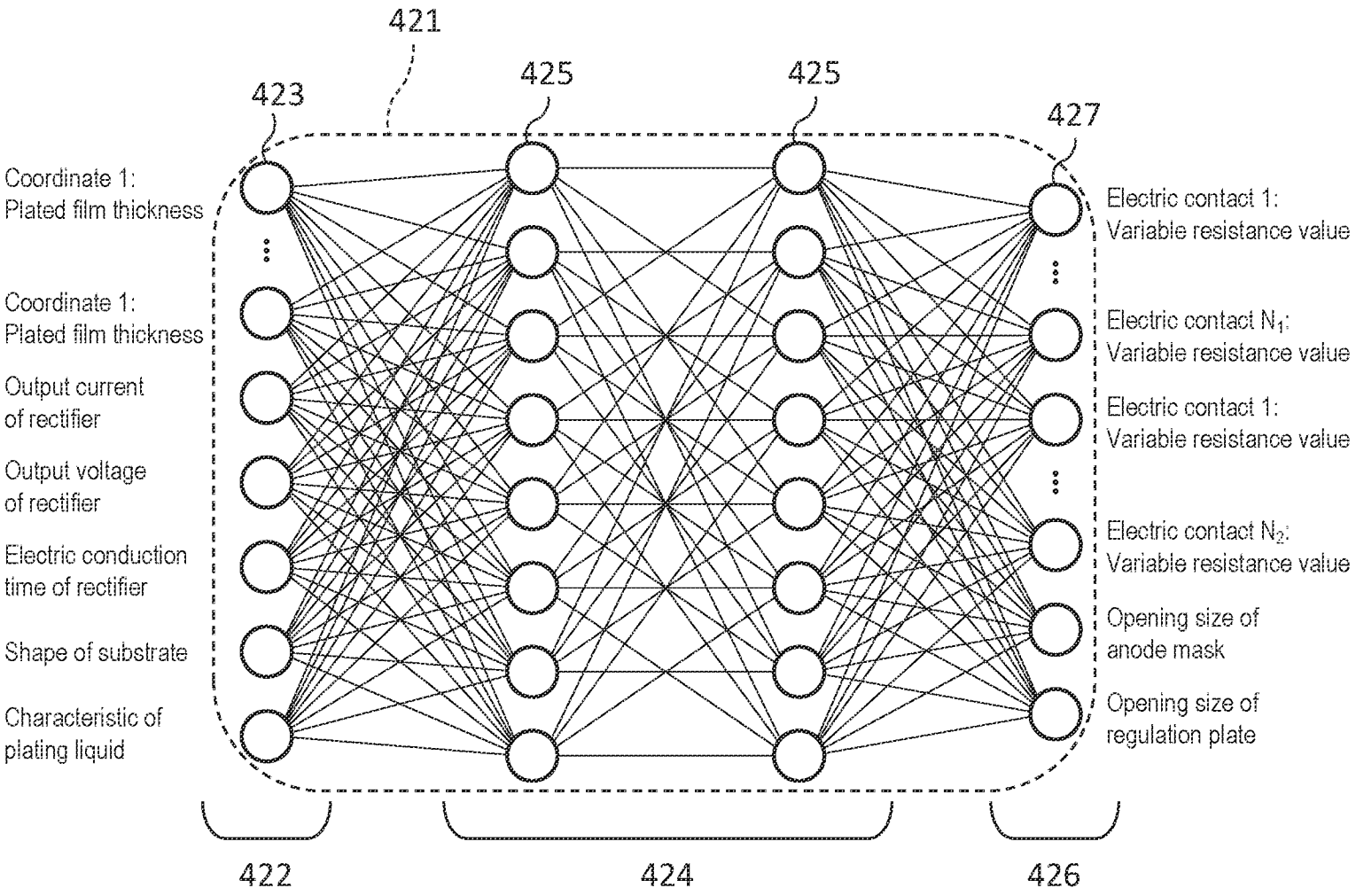
FIG. 5 is a figure showing example implementation of a machine learning model which is a component of the controller.

FIG. 5 shows an example implementation of the machine learning model 420. The machine learning model 420 comprises a neural network 421 which comprises: an input layer 422 comprising plural input nodes 423; an intermediate layer 424 comprising one or plural layers, each comprising plural nodes 425; and an output layer 426 comprising plural output nodes 427. One node is connected, with strength characterized by a weighting parameter, to plural nodes in a layer that is adjacent to a layer to which the one node belongs. In a learning (training) phase, a learned machine learning model 420 is constructed as a result that weighting parameters used between respective nodes are updated by using a large quantity of learning data. In an operation (inferring/forecasting) phase, respective resistance values of the respective variable resistors 228 and 248 are determined by using the learned machine learning model 420.

As shown in FIG. 5, the input nodes 423 of the machine learning model 420 are associated with plated-film thickness values at plural coordinates 1-M on the substrate W, and the output nodes 427 of the machine learning model 420 are associated with respective resistance values of the respective variable resistors 248 connected to the respective electric contacts 1-$N_1$ (electric contacts 242) on the substrate W and respective resistance values of the respective variable resistors 228 connected to the respective electric contacts 1-$N_2$ (electric contacts 222) on the anode 221. In this regard, the positions of the plural coordinates 1-M do not relate to the positions of the electric contacts 222 and 242, and the number M may be different from the numbers $N_1$ and $N_2$ of the electric contacts. As explained above, the respective resistance values of the respective variable resistors 228 and 248 affect the film-thickness distribution of the plated film formed on the substrate W. Thus, by constructing the machine learning model 420 in such a manner that the film-thickness distribution (i.e., respective film thickness values of respective coordinates) is inputted therein and respective resistance values of the respective variable resistors 228 and 248 are outputted therefrom, respective resistance values of the respective variable resistors 228 and 248 required for realizing desired film-thickness distribution can be inferred/determined. Further, by setting the thus determined resistance values to the variable resistors 228 and 248, respectively, a plated film having uniform film-thickness distribution can be formed on the substrate W.

The input nodes 423 of the machine learning model 420 may be associated with data other than the data of values of thickness of the plated film. For example, in the case that constant electric current is outputted from the rectifier 270, the output voltage of the rectifier 270 changes if the resistance values of the variable resistors 228 and 248 change, and the output voltage of the rectifier 270 also changes according to the magnitude of the constant electric current outputted from the rectifier 270. Further, the output electric current value and the output voltage value, that are designed values, of the rectifier 270 relate to a value of combined resistance between the positive terminal 271 and the negative terminal 272 of the rectifier 270 (in addition to the resistance values of the variable resistors 228 and 248, it includes contact resistance at the electric contacts 222 and 242, wiring resistance of the anode-side electric wires 226 and the substrate-side electric wires 246, chemical-solution resistance of the plating liquid Q, polarization resistance on the surfaces of the substrate W and the anode 221, and so on). Further, regarding the plated film formed on the substrate W, respective film thickness values at respective points within the substrate surface and an average thickness value of the film within the substrate surface change according to the magnitude of the constant electric current supplied from the rectifier 270, distribution of respective electric currents flowing through the respective electric contacts 222 and 242, electric conduction time during that the constant electric current is outputted from the rectifier 270, the shape of the substrate W (the opening area of the substrate W, the opening ratio of the substrate W, the thickness of a seed layer formed on the surface of the substrate W, and so on), a characteristic of the plating liquid Q (concentration, temperature, chemical components, and so on), and so on. In this regard, the opening area of the substrate W refers to an area of the part, in the front-side surface of the substrate W, that are not covered by an oxide film and an insulating film such as a resist (i.e., the part where a plated film is actually formed); and the opening ratio of the substrate W is defined as a ratio of the opening area relative to the area of the front-side surface of the substrate W.

Accordingly, like the machine learning model 420 in FIG. 5, it will be advantageous if any one or some of (1) the value of electric current supplied between the anode 221 and the substrate W, (2) the value of the voltage applied between the anode 221 and the substrate W, (3) the electric conduction time during that electric current is made to flow between the anode 221 and the substrate W, (4) information relating to the shape of the substrate W (the opening area of the substrate W, the opening ratio of the substrate W, the thickness of a seed layer formed on the surface of the substrate W, and so on), and (5) information relating to a characteristic of the plating liquid Q (concentration, temperature, chemical components, and so on of the plating liquid Q) is/are further associate with the input nodes 423. By the above construction, respective resistance values of the respective variable resistors 228 and 248 can be inferred/determined more accurately.

The resistance values of the variable resistors 228 and 248 associated with the output nodes 427 of the machine learning model 420 are objects of control by the controller 400. That is, the controller 400 operates to determine, according to a given condition (i.e., values inputted to the input nodes 423), optimum resistance values of the variable resistors 228 and 248. In addition to the resistance values of the variable resistors 228 and 248, the controller 400 may treat other elements as objects of control. For example, the anode mask 225 and the regulation plate 230 arranged in positions between the anode 221 and the substrate W (refer to FIG. 2) affect distribution of the electric field in the plating liquid Q between the anode 221 and the substrate W, and further affect uniformity in film thickness of the plated film formed on the substrate W. Accordingly, like the machine learning model 420 in FIG. 5, it is possible to associate, with the output nodes 427, one of or both the size (the opening diameter) of the opening 225*a* of the anode mask 225 and the size of the opening 230*a* of the regulation plate 230. By applying the opening diameters/diameter determined by use of the above machine learning model 420 to the anode mask 225 and/or regulation plate 230, uniformity in film thickness of the plated film formed on the substrate W can be further improved.

It should be reminded that the sizes of the opening 225*a* of the anode mask 225 and the opening 230*a* of the regulation plate 230 may be associated with the input nodes 423 instead of the output nodes 427. In the case that the machine learning model 420 is constructed as explained above, optimum resistance values of the variable resistors 228 and 248 can be determined, respectively, by the machine learning model, according to the sizes of the opening 225*a* of the anode mask 225 and the opening 230*a* of the regulation plate 230 in addition to the respective parameters explained in above items (1)-(5).

Figure 6:
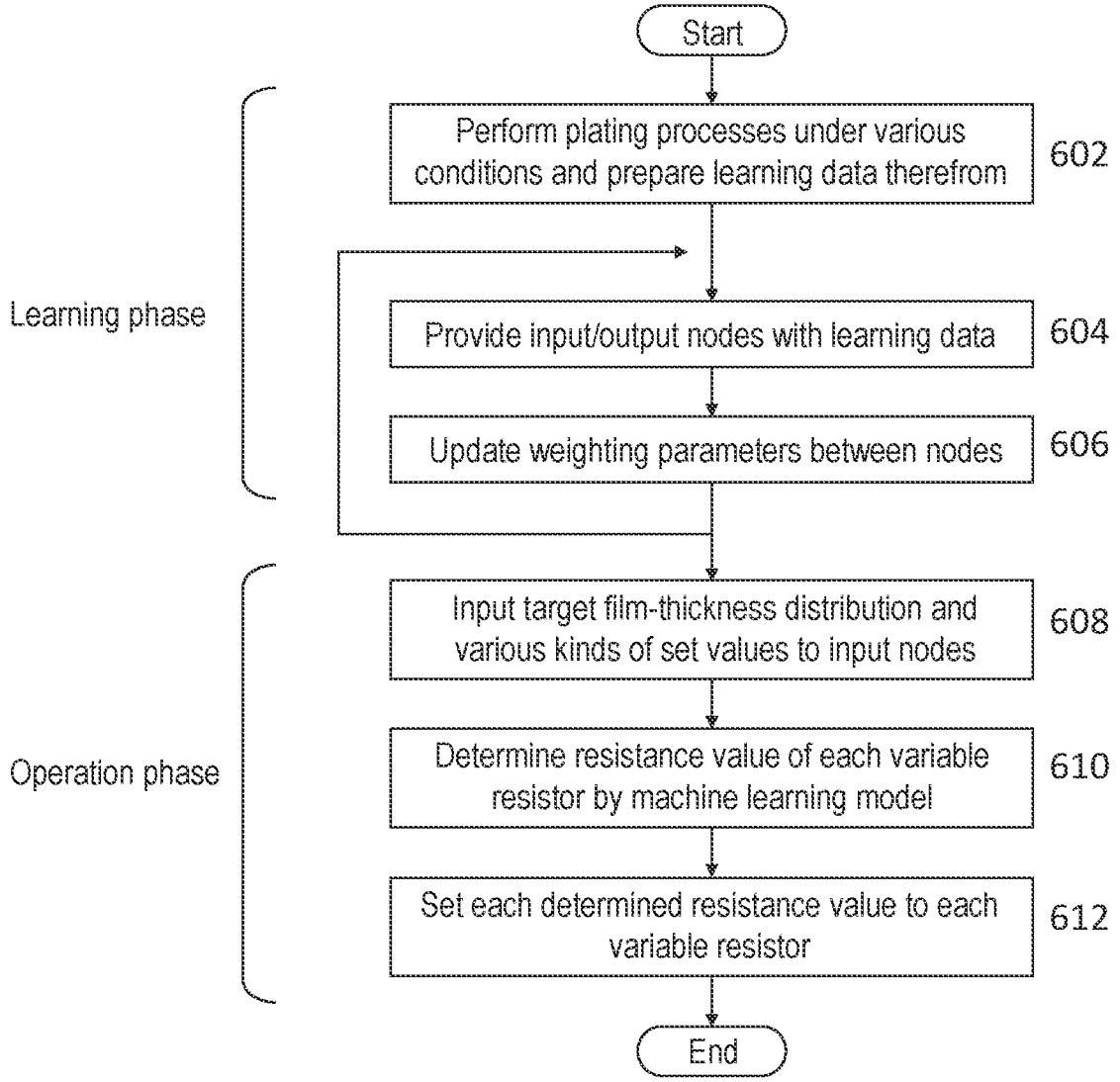
FIG. 6 is a flowchart showing a learning phase and an operation phase of the machine learning model.

FIG. 6 is a flowchart showing a learning phase and an operation phase of the machine learning model 420. A large quantity of data is required for training the machine learning model 420 in the learning phase. The above learning data can be prepared by performing, in the plating module 110, plating processes under various conditions (step 602). For example, the respective resistance values of the respective variable resistors 228 and 248, the opening sizes of the masks (the anode mask 225 and the regulation plate 230) for adjusting the electric field, the value of the electric current outputted from the rectifier 270 and the electric conduction time during that the electric current flows, the shape of the substrate W, and the characteristic of the plating liquid Q are set to certain conditions, respectively, and a plating process is performed. Next, during the plating process, the value of the output voltage of the rectifier 270 is measured; and, after completion of the plating process, respective thickness values at respective coordinates 1-M on the substrate W of the plated film are measured. The above respective set values and measured values form a set of learning data. By setting plural different conditions to the plating module 110 and performing plating processes and measurement similarly, a large number of sets of learning data are formed.

Next, a set of learning data, that has been formed, is supplied to respective nodes of the input nodes 423 and the output nodes 427 of the machine learning model 420 (step 604), and weighting parameters between respective nodes are updated (step 606). Steps 604 and 608 are repeated with respect to a large number of sets of learning data, and training of the machine learning model 420 progresses thereby. After the training has proceeded to a predetermined stage, the machine learning model 420 can be used in the operation phase.

In the operation phase, target film-thickness distribution of the plated film (that is, plated film thickness at the coordinates 1-M on the substrate W) and respective set values of the plating module 110 (the value of the output electric current of the rectifier 270 and so on) are inputted to the input nodes 423 of the machine learning model 420 (step 608). For example, the above inputting may be that performed by an operator of the plating apparatus 10 via a user interface of the controller (computer) 400. Next, in response to the data inputted to the input nodes 423, the machine learning model 420 can output, from the output nodes 427, respective resistance values of the respective variable resistors 228 and 248 and the opening sizes of the anode mask 225 and the regulation plate 230, that are required for realizing the target film-thickness distribution of the plated film (step 610). The respective resistance values, that are determined as explained above by the machine learning model 420, are set to the respective variable resistors 228 and 248 by the controller 400 (and the determined opening sizes are also set to the anode mask 225 and the regulation plate 230 as necessary) (step 612).

Next, in the plating module 110 in which the respective variable resistors 228 and 248 (and the opening sizes of the anode mask 225 and the regulation plate 230) have been set to have optimum values, the plating process for the substrate W is performed. By the above construction, a plated film having target film-thickness distribution can be formed on the substrate W. In this regard, in the case that it is possible to measure the plated film thickness at respective coordinates 1-M on the substrate W in real time, the film-thickness distribution of the plated film formed on the substrate W can be controlled more precisely, by repeating the learning phase and the operation phase explained above by using therein the thus measured data, at respective points in time, of film thickness.

Figure 7:
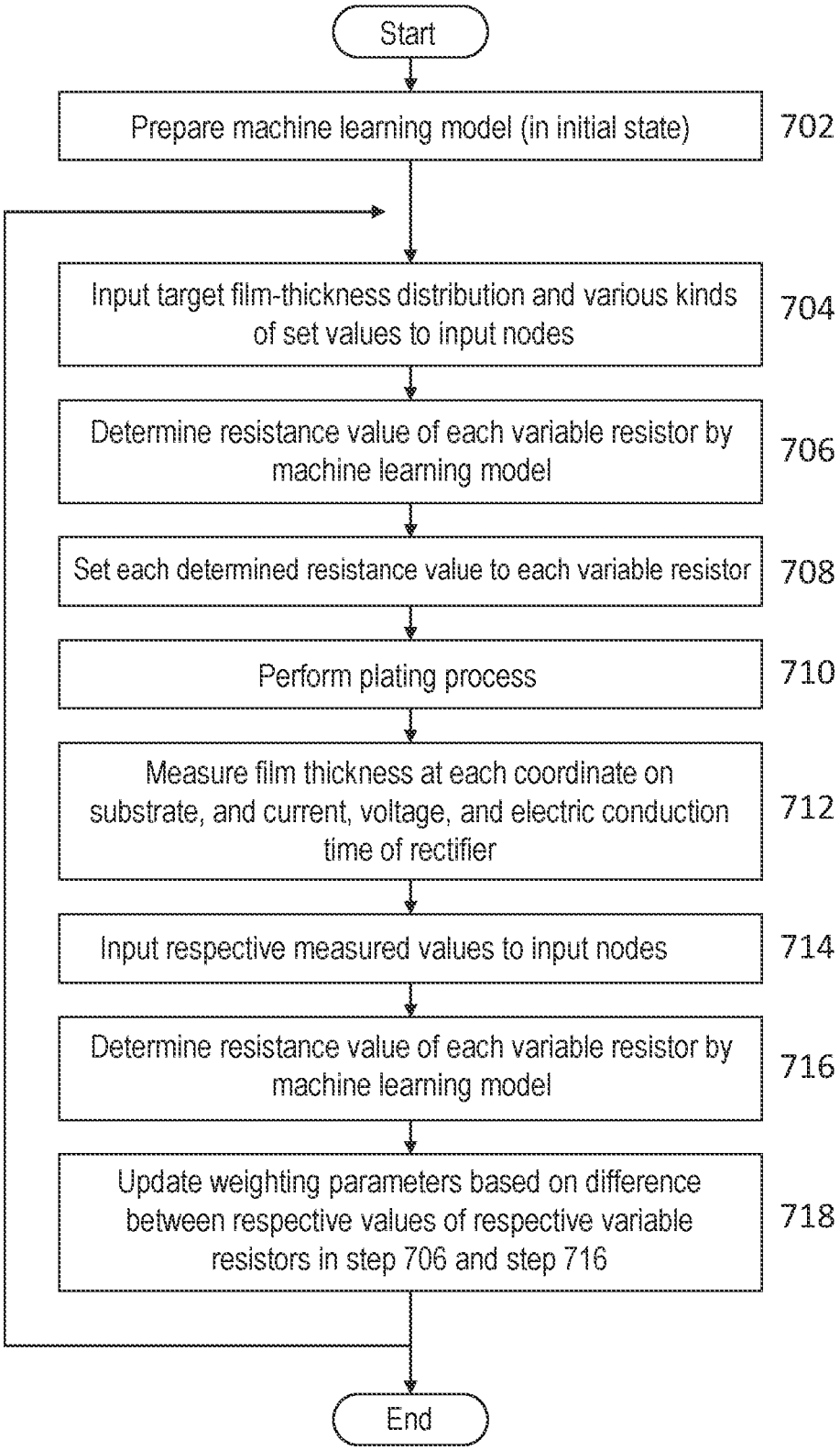
FIG. 7 is a flowchart showing a method that makes it possible to train the machine learning model more efficiently.

FIG. 7 is a flowchart showing a method that makes it possible to train the machine learning model 420 more efficiently, by performing learning and operation in parallel in the machine learning model 420. First, in step 702, a machine learning model 420, in which the weighting parameters between respective nodes have been set to initial values, is prepared. The machine learning model 420, in which the weighting parameters have been set to initial values, may be a machine learning model 420 in which learning thereof according to the learning phase in the above-explained flowchart in FIG. 6 has progressed to a certain extent, for example. In a different construction, a machine learning model 420, in which the weighting parameters have been set to initial values, may be obtained by performing predetermined theoretical calculation or simulation to thereby calculate respective resistance values of the respective variable resistors 228 and 248 from the target film-thickness distribution, the electric current value, the voltage value, the electric conduction time, and so on, and making the machine learning model 420 perform learning, in advance, by using the above data.

Next, in step 704, target film-thickness distribution of the plated film (that is, plated film thickness at the coordinates 1-M on the substrate W) and respective set values of the plating module 110 (the output electric current value, the output voltage value, and the electric conduction time relating to the rectifier 270, and the shape of the substrate W and the characteristic of the plating liquid Q) are inputted to the input nodes 423 of the machine learning model 420. In step 706, in response to the data inputted to the input nodes 423, the machine learning model 420 can output, from the output nodes 427, respective resistance values of the respective variable resistors 228 and 248 and the opening sizes of the anode mask 225 and the regulation plate 230 that are required for realizing the target film-thickness distribution of the plated film. In step 708, the controller 400 sets the respective resistance values determined in step 706 to the respective variable resistors 228 and 248, and sets the opening sizes to the anode mask 225 and the regulation plate 230. In this regard, above steps 704-708 correspond to steps 608-612 in the above-explained flowchart in FIG. 6.

Next, in step 710, in the plating module 110 in which respective kinds of setting have been applied thereto as explained above, the plating process is performed; and, in step 712, the output electric current value, the output voltage value, and the electric conduction time relating to the rectifier 270 when the plating process is being performed, and the film thickness values at coordinates 1-M on the substrate W of the plated film, which is formed on the substrate W by the above plating process, are measured. Next, in step 714, the respective measured values, that have been measured in step 712, are inputted to the input nodes 423 of the machine learning model 420; and, in step 716, the machine learning model 420 outputs, from the output nodes 427, respective resistance values of the respective variable resistors 228 and 248 in response to the data inputted to the input nodes 423.

The respective resistance values of the respective variable resistors 228 and 248 calculated by the machine learning model 420 in above step 706 correspond to the film-thickness distribution of the plated film targeted in the plating process, and the respective resistance values of the respective variable resistors 228 and 248 calculated in above step 716 correspond to the film-thickness distribution of the plated film that is obtained by actually performing the plating process. In step 718, the controller 400 calculates difference between the respective resistance values of the respective variable resistors 228 and 248 calculated in step 706 and the respective resistance values of the respective variable resistors 228 and 248 calculated in step 716, and, based on the difference, updates the weighting parameters between respective nodes in the machine learning model 420. For example, backpropagation can be used for updating of the weighting parameters. By the above construction, the weighting parameters between respective nodes in the machine learning model 420 are improved to suit the actually obtained film-thickness distribution of the plated film; and, as a result, the machine learning model 420 is made to be able to calculate more accurate resistance values of the variable resistors 228 and 248.

The cycle comprising steps 704-718 can be repeated any number of times, and optimization of the machine learning model 420 can be further progressed as a result of repeating of the cycle.

In the above description, embodiments of the present invention have been explained based on some examples; and, in this regard, the above embodiments of the present invention are those used for facilitating understanding of the present invention, and are not those used for limiting the present invention. For example, although the plating apparatus 10 explained with reference to FIGS. 1 and 2 is the so-called dip-type plating apparatus, the present invention can be applied to the so-called cup-type plating apparatus wherein a to-be-plated surface of a substrate such as a semiconductor wafer or the like is oriented to a downward side (face down) and the substrate is held horizontally, and the substrate is plated by spouting plating liquid from the bottom. It is obvious that the present invention can be changed or modified without departing from the scope of the gist thereof, and that the present invention includes equivalents thereof. Further, it is possible to arbitrarily combine components or omit a component(s) disclosed in the claims and the specification, within the scope that at least part of the above-stated problems can be solved and/or within the scope that at least part of advantageous effect can be obtained.

REFERENCE SIGNS LIST

10 Plating apparatus
30 Substrate holder
100 Cassette
102 Cassette table
104 Aligner
106 Spin rinse dryer
110 Plating module
114 Plating tank
120 Load/unload station
122 Transfer robot
124 Stocker
126 Pre-wet module
128 Pre-soak module
130*a* First rinse module
130*b* Second rinse module
132 Blow module
136 Overflow tank
140 Transfer device
142 First transfer device
144 Second transfer device
150 Rail
152 Loading plate
160 Paddle driver
162 Paddle follower
220 Anode holder
221 Anode
222 Electric contact
223 Electric terminal
225 Anode mask
225*a* First opening
226 Anode-side electric wiring
228 Variable resistor
230 Regulation plate
230*a* Second opening
242 Electric contact
243 Electric terminal
246 Substrate-side electric wiring
248 Variable resistor
255 Partition wall
256 Plating liquid supply port
257 Plating liquid exhaust port
258 Plating liquid circulating device
270 Rectifier
271 Positive terminal
272 Negative terminal
400 Controller
420 Machine learning model
421 Neural network
422 Input layer
423 Input node
424 Intermediate layer
425 node
426 Output layer
427 Output node
Q Plating liquid
W Substrate
W1 Plated surface

What is claimed is:

1. A plating apparatus for plating a substrate by making electric current flow from an anode to the substrate, the plating apparatus comprising:

plural anode-side electric wires which are electrically connected to the anode via plural electric contacts on the anode;

plural substrate-side electric wires which are electrically connected to the substrate via plural electric contacts on the substrate;

plural variable resistors positioned, in at least one of the anode side and the substrate side, in middle positions in the plural anode-side electric wires or the plural substrate-side electric wires; and a controller configured to adjust each of resistance values of the plural variable resistors, wherein the controller is configured to:

determine each of the resistance values of the plural variable resistors by using a machine learning model, wherein input to the machine learning model is plated film thickness at respective points on the substrate, and output from the machine learning model is the respective resistance values of the respective variable resistors, and set the determined resistance values to the plural variable resistors, respectively, and make the plating apparatus perform a plating process, wherein the input of the machine learning model further comprises at least one of: electric conduction time during which electric current is made to flow between the anode and the substrate, an opening area of the substrate, or an opening ratio of the substrate.

2. The plating apparatus according to claim 1, wherein the input of the machine learning model further comprises at least one of a value of electric current supplied between the anode and the substrate, a value of a voltage applied between the anode and the substrate, electric conduction time during that electric current is made to flow between the anode and the substrate, information relating to the shape of the substrate, and information relating to a characteristic of a plating liquid used for plating of the substrate.

3. The plating apparatus according to claim 2, wherein the information relating to the shape of the substrate comprises at least one of an opening area of the substrate, an opening ratio of the substrate, and thickness of a seed layer formed on a surface of the substrate.

4. The plating apparatus according to claim 1, wherein the output of the machine learning model further comprises a size value of a mask, which is arranged in a position between the anode and the substrate, for adjusting an electric field between the anode and the substrate.

5. The plating apparatus according to claim 1, wherein the controller is constructed to calculate, by using the machine learning model, the resistance values of the plural variable resistors, respectively, based on at least respective target values of plated film thickness at respective points on the substrate;

set the calculated resistance values to the plural variable resistors, respectively;

make a plating process be performed in the plating apparatus in which the resistance values have been set to the plural variable resistors, respectively;

obtain each of measured values of the plated film thickness at each of the points on the substrate;

calculate, by using the machine learning model, the resistance values of the plural variable resistors, respectively, based on at least the respective obtained measured values of the plated film thickness at the respective points on the substrate; and update the machine learning model based on difference between each of the resistance values of the plural variable resistors calculated in the former calculating step and each of the resistance values of the plural variable resistors calculated in the latter calculating step.

6. The plating apparatus according to claim 1, wherein the controller adjusts each of the resistance values of the plural variable resistors in such a manner that a sum of values of resistance on respective paths of the plural anode-side electric wires or the plural substrate-side electric wires becomes substantially equal, regardless of a value of contact resistance at each of the plural electric contacts.

7. The plating apparatus according to claim 6, wherein the controller adjusts each of the resistance values of the plural variable resistors in such a manner that electric currents, that are substantially equal to one another, flow through the respective paths of the plural anode-side electric wires or the plural substrate-side electric wires.

8. The plating apparatus according to claim 1, wherein the controller adjusts each of the resistance values of the plural variable resistors in such a manner that the resistance value of the variable resistor connected to the electric contact in a position near a center of the anode is determined to be that relatively small, and the resistance value of the variable resistor connected to the electric contact in a position near a periphery of the anode is determined to be that relatively large.

9. The plating apparatus according to claim 1, wherein each of the resistance values of the plural variable resistors is larger than each of the contact resistance values at the electric contacts.

10. The plating apparatus according to claim 9, wherein each of the resistance values of the plural variable resistors is equal to or larger than a resistance value that is ten times larger than each of the contact resistance values at the electric contacts.

11. A method for plating a substrate by making electric current flow from an anode to the substrate in a plating apparatus, wherein the plating apparatus comprises:

plural anode-side electric wires which are electrically connected to the anode via plural electric contacts on the anode;

plural substrate-side electric wires which are electrically connected to the substrate via plural electric contacts on the substrate; and plural variable resistors positioned, in at least one of the anode side and the substrate side, in middle positions in the plural anode-side electric wires or the plural substrate-side electric wires; and the method comprises a step for determining each of resistance values of the plural variable resistors by using a machine learning model, wherein input to the machine learning model is plated film thickness at respective points on the substrate, and output from the machine learning model is the respective resistance values of the respective variable resistors, and a step for setting the determined resistance values to the plural variable resistors, respectively, and making a plating process be performed in the plating apparatus.

* * * * *